United States Patent [19]

Levine

[11] 4,011,673

[45] Mar. 15, 1977

[54] VISUAL INDICIA BEARING CLIP

[76] Inventor: Irving Levine, 23555 Park Belmonte, Calabassas Park, Calif. 91302

[22] Filed: Nov. 19, 1975

[21] Appl. No.: 633,253

[52] U.S. Cl. ..... 40/23 A; 24/67.9

[51] Int. Cl.[2] ..... G09F 3/16

[58] Field of Search ..... 40/23 A, 23 R, 24, 11 R, 40/11 A, 10 C, 359, 360, 125 E; 24/67.9, 67.3, 67 R, 246, DIG. 9, DIG. 65; 35/62

[56] References Cited

UNITED STATES PATENTS

| | | | |
|---|---|---|---|
| 1,886,801 | 11/1932 | Freiberg | 35/62 |
| 2,554,105 | 5/1951 | Heinle | 40/10 C |
| 2,927,359 | 3/1960 | Thomas | 24/DIG. 9 |
| 3,249,978 | 5/1966 | Shears | 24/246 |

FOREIGN PATENTS OR APPLICATIONS

| | | | |
|---|---|---|---|
| 1,183,595 | 1/1959 | France | 40/23 R |
| 1,293,325 | 10/1972 | United Kingdom | 24/67.9 |

OTHER PUBLICATIONS

Modern Plastic, Sept. 1946, p. 111, CL40–10C.

*Primary Examiner*—John F. Pitrelli

[57] ABSTRACT

An apparatus for binding paper sheets and related articles incorporating means for exhibiting replaceable visual indicia to be used as a tabbing, marking, signaling and clipping device. A moldable material exhibiting suitable resiliency and strength forms the present invention clip. A base portion depends into a substantially V-shaped outer clamping member. An inner clamping arm is interposed centrally within the V-shaped member from the common base, the inner clamp member including a central spine having a cross-section which is larger than the inner clamping member. A pair of concave indentations lie adjacent to and on opposite sides of the inner clamping member, the concave indentations extending into the base of the clip. The surface of the base of the clip comprises a lattice of perpendicular ridges, the lattice work appearing on both sides of the base. The spacing between each set of parallel ridges comprising the lattice permits removeable coloration thereof by ink, pencil or other conventional marking instruments.

7 Claims, 6 Drawing Figures

Fig. 1
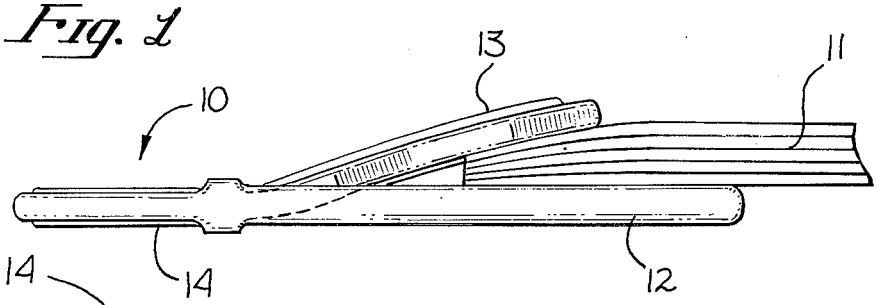
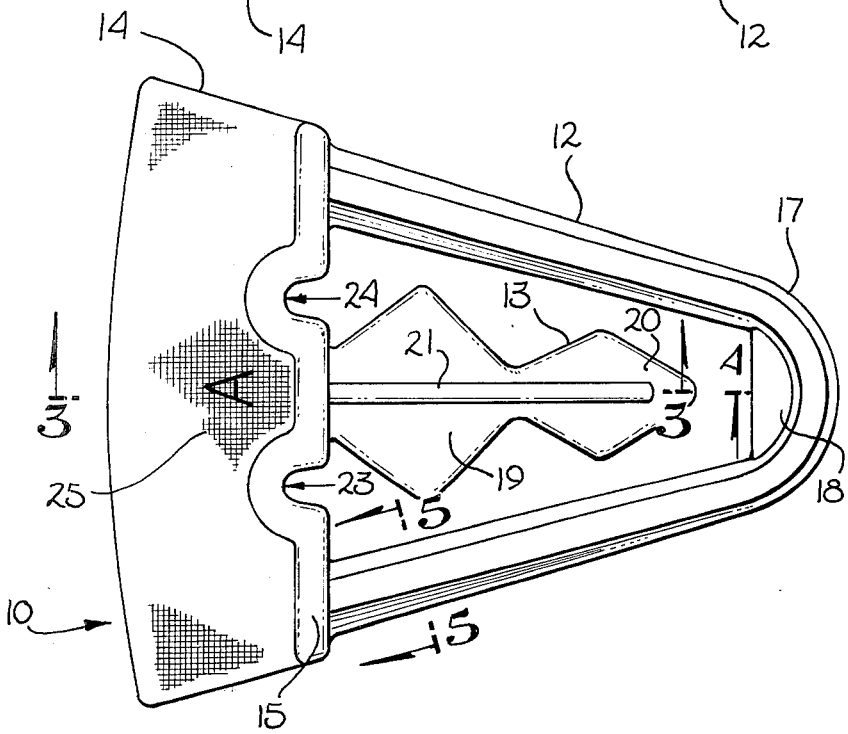
Fig. 2
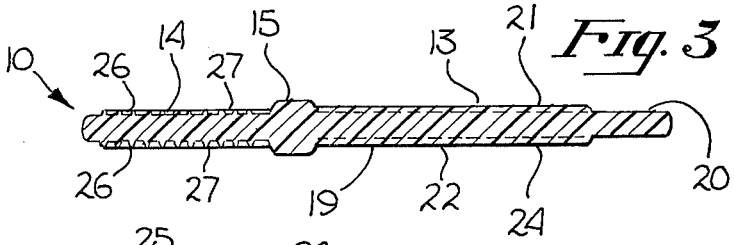
Fig. 3
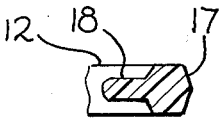
Fig. 4
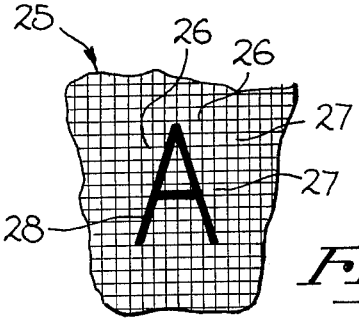
Fig. 6
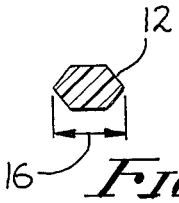
Fig. 5

VISUAL INDICIA BEARING CLIP

BACKGROUND OF THE INVENTION

1. Field of the Invention

The present invention generally relates to clamping apparatus used to removeably clamp documents or other like articles and, more particularly, to those clamping apparatus which include means for providing visual tabs or indicia.

2. Prior Art

The prior art exhibits a number of devices which are conventionally described as paper clips or visual tabs which are used to clamp together papers, documents or other like objects as well as act as visual signals. The primary feature which must be exhibited by all clipping devices is the ability to provide an adequate clamping force without damaging the documents or the structure of the clip itself. Another difficulty with the fabrication of an adequate clipping device is the ability to clamp a pad of sheets which may comprise more than an insignificant number. The clamping devices disclosed by the prior art typically require that the number of sheets be sufficiently small for the pad to bend between the inner and outer clamping limbs of the clip. If the clip is used on a pad of sheets which is excessively thick, the free ends of the clamp stand off from the pad of sheets thereby raising the possibility that the clipping device will slide off of the sheets.

A specific type of clip which is disclosed by the prior art for clamping thicker documents is generally referred to as a butterfly clip. Butterfly clips are relatively complicated structures made from steel or wire and have two intercrossing clamping portions which grip the pad of sheets from both sides. These clips are expensive, susceptible to corrosion and, owing to their sharp ends, tend to damage the documents. Furthermore, they are extremely disadvantageous because of their shape and size when same are sought to be used in the mail.

The prior art discloses a number of clamping devices which are fabricated from injection molded plastic. The devices take a number of shapes, but typically all utilize a common structure. In one case, a substantially triangular outer clamping limb is utilized, one side of the triangle being open, each of the sections of the open side depending into inner clamping limbs which are parallel to each other and which are joined at a point within the triangle of the outer clamping limb. The common portion of the inner clamping limb flares outwardly into a pair of arms which are substantially parallel to the remaining two sections of the outer clamping limb. By fabricating the inner clamping limb with the pair of parallel members joined at the end thereof, this clip seeks to provide more flexibility at the point where the inner clamping limb joins the outer clamp. The deficiency of this device arises out of the inability to apply an adequate clamping force to the document being bound. This fully defeats the primary objective of the clamping structure, i.e., being capable of holding a thick pad of sheets while simultaneously applying an adequate clamping force.

Another device disclosed by the prior art utilizes a pair of substantially U-shaped clamping members which are interconnected by cross-portions to form an endless strand. As with the base of the clip described hereinabove, the structure seeks to add resiliency by including an opening within the inner clamping arm.

The inadequacy of the structure is created by precisely the elements which are added to provide resiliency. By adding resiliency to the inner arm, the ability to provide adequate clamping strength is reduced.

The present invention substantially overcomes the deficiencies which are exhibited by the devices disclosed by the prior art. A substantially V-shaped outer clamping limb is joined to a base portion at the opening of the outer limb, the profile of the outer clamping limb providing strength to the structure. An inner clamping arm depends centrally into the opening of the outer clamping limb, the profile of the inner clamping arm combining strength and resiliency. To provide the ability to clamp thick pads of sheets, a pair of concave indentations lie adjacent to and on opposite sides of the inner clamping arm. The weakening of the base portion adjacent the inner clamping arm provides that resiliency to the inner clamping arm which is necessary to permit the separation necessary to clamp a thick pad of sheets. To increase the utility of the present invention, the base portion incorporates a lattice of perpendicular ridges which produce a surface which can be discolored by pencil, ink or other marking devices.

SUMMARY OF THE INVENTION

The present invention comprises an apparatus to function as a tab, marker, signal and clip, and in particular as an apparatus for binding a pad of sheets which includes a portion for exhibiting visual indicia. A visual indicia member is fabricated from the base of the clip. The base member exhibits a pair of parallel surfaces which are formed by a lattice of parallel sets of ridges, the sets preferably being directed perpendicular to each other. The outer edges of the base portion depend into a substantially V-shaped outer clamping limb. Although the preferred form of the present invention utilizes a V-shaped section, it is obvious to one having skill in the art that alternative geometrical shapes can be utilized such as a U-shaped section. In order to provide strength to the outer clamping arm, the profile thereof is a hexagon which is tapered from the top to the bottom thereof.

The inner clamping arm of the present invention clip depends downwardly from the base portion and extends centrally into the outer clamping limb. The thickness of the inner clamping arm is sufficiently small to provide resiliency to the structure. In order to give the inner clamping arm sufficient strength to apply an adequate clamping force to a thick pad of sheets, a central spine is disposed along the center of the inner clamping arm, the thickness of the spine being greater than that of the base of the inner clamping arm.

In order to provide a clip which is sufficiently resilient to grip a thick pad of sheets while applying an adequate clamping force, a pair of concave indentations are disposed into the base member adjacent to and on opposite sides of the inner clamping arm. The weakening of the base member adjacent the inner clamping arm provides additional length to the inner clamping arm to provide the resiliency necessary to meet the objectives of the present invention.

It is therefore an object of the present invention to provide an improved tabbing, marking, signaling and clamping apparatus.

It is another object of the present invention to provide a clamping apparatus which incorporates means for illustrating visual indicia.

It is yet another object of the present invention to provide a clipping apparatus capable of binding thick pads of sheets while maintaining an adequate clamping force thereon.

It is still yet another object of the present invention to provide a clip apparatus which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWING

FIG. 1 is a side elevation view of the present invention clamping a pad of sheets.

FIG. 2 is a front view of a clipping apparatus fabricated in accordance with the present invention.

FIG. 3 is a side elevation, cross-sectional view of the common base and inner clamping arm shown in FIG. 2 taken through line 3—3 of FIG. 2.

FIG. 4 is a side elevation, cross-sectional view of the bottom of the outer clamping limb shown in FIG. 2 taken through line 4—4 of FIG. 2.

FIG. 5 is a cross-sectional view of a portion of the outer clamping limb shown in FIG. 2 taken through line 5—5 of FIG. 2.

FIG. 6 is an enlarged view of the visual indicia receiving surface shown in FIG. 2 illustrating the disposition of indicia disposed thereon.

DESCRIPTION OF THE PRESENTLY PREFERRED EMBODIMENT

Referring to FIG. 1, an understanding of the manner of the application of the present invention apparatus can be best seen, the apparatus being generally designated by the reference numeral 10. The present invention is used as a tabbing, marking, signaling and clipping apparatus, all functions thereof requiring that it be able to be clipped to the receiving media. Clip 10 is shown in FIG. 1 clamping a pad of sheets 11. Since the utilization of the present invention shown in FIG. 1 is exemplary only, it is clear that use thereof encompasses tabbing, marking and signaling functions. Clip 10 comprises an outer clamping limb 12 and an inner clamping arm 13. The pad of sheets 11 is held firmly between outer clamping limb 12 and inner clamping arm 13 by the converging force which is imposed by the connection of clamping limb 12 and clamping arm 13 to base 14.

Referring now to FIG. 2, a front view of the present invention clip apparatus can be best seen. The present invention clip 10 utilizes a common base 14 from which the other elements depend. Outer clamping limb 12 is a substantially V-shaped member which depends from the enlarged ridge 15 extending along the bottom of base 14. As can be seen in FIG. 5, the profile of outer clamping limb 13 is hexagonal along the full duration thereof. A comparison of FIG. 5 and FIG. 2 illustrates that the major axis 16 of the hexagon comprising outer clamping limb 12 decreases from the point where it intersects ridge 15 to the bottom of clamping limb 13 identified by the reference numeral 17. The tapered profile of the arms of outer clamping limb 12 provides that the structure is flexible while also insuring that the structure will have sufficient strength to withstand the converging forces necessary to clamp pad 11 (FIG. 1). In order to prevent outer clamping limb 12 from excessively reacting to torsional forces, supporting insert 18 is disposed across the lowermost portion 17 of outer clamping limb 12 coupling the major axis of the hexagonal sections of limb 12.

Inner clamping arm 13 can be best seen by reference to FIG. 2 and FIG. 3. Inner clamping arm 13 depends centrally from ridge 15 of base 14 within the opening created by outer clamping limb 12. As can be seen from FIG. 2, clamping arm 13 comprises a pair of lateral extended surfaces 19 and 20 which will provide the means to apply the clamping force to pad 11. Clamping arm 13 comprises a pair of parallel surfaces, the width thereof being designated as the lateral extended widths 19 and 20. The lateral width of extended surface 20 is reduced from that designated by the reference numeral 19 to provide flexibility while insuring adequate strength to bind pad 11. To provide additional strength to clamping arm 13, spines 21 and 22 are centrally disposed along the opposite parallel surfaces of clamping arm 13. The thickness of arm 13 along spines 21 and 22 is greater than the remainder of the surfaces 19 and 20 of clamping arm 13 as is amply shown in FIG. 3.

As stated previously, one of the defects in the devices disclosed by the prior art arises from the inability to provide resiliency and simultaneously provide adequate clamping forces to insure that pad 11 or similar objects can be held. As can be seen in FIG. 2, concave indentations 23 and 24 are disposed into enlarged ridge 15, ridge 15 following the contour of indentations 23 and 24. Concave indentations 23 and 24 lie on opposite sides of and are adjacent to inner clamping arm 13. By providing concave indentations 23 and 24, the effective length of inner clamping arm 13 is extended to add to the resiliency of the structure. When pad 11 is inserted intermediate outer clamping limb 12 and inner clamping arm 13, concave indentations 23 and 24 will provide for an increased arc through which clamping arm 13 can be moved. In addition, spines 21 and 22 coupled with enlarged ridge 15 provide the strength necessary to insure that adequate clamping power will be available.

As stated previously, one of the objectives of the present invention is to provide a surface which is suitable to display visual indicia. This permits the present invention to operate as a tabbing, marking and signaling device. FIG. 6 illustrates an enlarged view of surface 25 of base 14. Surface 25 comprises a lattice of intersecting sets of ridges 26 and 27. It is preferable that ridges intersect at a 90° angle, this can be altered to provide any suitable oblique angle. Although FIG. 2 and FIG. 6 illustrate only a single surface 25, it is obvious that surface 25 can be formed on both of the parallel sides of base member 14. Each of the ridges 26 and 27 respectively comprise a plurality of parallel ridges which are in uniform spaced relation to one another. The lattice formed of ridges 26 and 27 produces a substantially uniform surface of alternate peaks and depressions which are suitable for the receipt of liquid, wax or graphite dispositions. In this manner, removeable visual indicia can be applied to and removed from surface 25 to permit the present invention to be used as a tab or like visual signaling apparatus. By providing the effective peaks and depressions created by lattice 25, the application of a graphite pencil, marking pen, etc., will cause the disposition of the liquid or wax within the depressions formed by the perpendicular ridges 26 and 27. Since ridges 26 and 27 are disposed in close proximity to one another, the indicia marked on surface 25 is removeable to provide for reuse of clip 10.

The present invention clip apparatus 10 is preferably fabricated from a resilient thermoplastic material, such as polyvinyl chlorie, but it is clear that other suitable moldable materials can be used. A typical process which can be used to form the present invention clip utilizes a suitable mold which is amenable to injection molding procedures which are well known to those persons having knowledge of the plastic molding art.

The present invention provides an improved clip apparatus which includes a tabbing surface for receiving visual indicia. By optimizing the resiliency and strength of the outer clamping limb 12 and inner clamping arm 13, the present invention clip 10 can bind a pad of sheets 11 without the deleterious effect normally associated with those clips disclosed by the prior art. In addition, the provision of an indicia receiving surface 25 permits clip 10 to be used as a tab in a manner which is in no way taught by those devices disclosed in the prior art. By incorporating indicia receiving surface 25 into the structure of the present invention, the utilization of same as a tab, mark and signal apparatus totally surpasses those structures illustrated by the prior art.

I claim:

1. A visual indicia clip apparatus comprising:

a. a base member having visual indicia bearing means for receiving visual data, said base member including a pair of concave indentations disposed into the bottom surface thereof;

b. an outer clamping limb depending from the bottom surface of said base member and having a pair of outer arms, said outer arms being substantially V-shaped, said outer clamping limb being tapered from the junction between each of said arms and the bottom surface of said base member; and c. an inner clamping arm depending from a ridge disposed along the bottom surface of the base member, said inner clamping arm being intermediate said concave indentations and centrally extending between the arms of said outer clamping limb, said inner clamping arm being in a planar relationship to said outer clamping limb, said inner clamping arm having first and second portions, said first portion being adjacent the bottom surface of said base member and extending laterally outwardly toward the outer arm of said outer clamping limb, the outermost lateral section of said first portion being tapered inwardly to a point adjacent said second portion, said second portion being tapered outwardly to a maximus which is less than the outermost lateral section of said first portion.

2. A visual indicia clipping apparatus as defined in claim 1 wherein said visual indicia bearing means comprises first and second sets of parallel ridges being disposed perpendicular to each other, said first and second sets of ridges forming a uniform disposition of peaks and depressions whereby marking data is removeably disposed thereon.

3. A visual indicia clipping apparatus as defined in claim 1 wherein the arms of said outer clamping limbs are hexagonal cross-sections, the major axis of said hexagon uniformly decreasing from the terminus of said arms to the point of juncture therebetween.

4. A visual indicia clipping apparatus as defined in claim 3 wherein the major axis of the hexagon of each of said arms are coupled together in the proximity of the juncture of the arms of said outer clamping limb.

5. A visual indicia clipping apparatus as defined in claim 1 wherein said inner clamping arm includes a spine depending from the ridge of said base and being uniformly disposed upon said inner clamping arm, said spine having a thickness which is greater than the thickness of said inner clamping arm.

6. A visual indicia clip apparatus comprising:

a. a base member having first and second parallel surfaces and including visual indicia bearing means for receiving visual data, said visual indicia bearing means being disposed withing said first and second surfaces, said base member including a strengthening, enlarged ridge extending along the bottom surface thereof, a pair of concave indentations being disposed into the bottom surface of said ridge and being bounded thereby;

b. an outer clamping limb having a pair of outwardly directed arms in a substantially V-shaped configuration, the arms of said outer clamping limb being hexagonal in cross-section, the arms of said outer clamping member being integral with the enlarged ridge of said base member and being uniformly disposed about said concave indentations, the major axis of said hexagonal arms uniformly decreasing from the connection to the ridge of said base member to the point of juncture between the arms of said outer clamping limb, the major axes of the hexagonal arms being coupled together in the proximity of the juncture of the arms of said outer clamping limb; and c. an inner clamping arm uniformly depending from the enlarged ridge of said base member into the opening intermediate the arms of said outer clamping limb, said inner clamping arm being in a planar relationship to said outer clamping limb, said inner clamping arm comprising first and second portions, said first portion being adjacent the ridge of said base member and extending laterally outwardly toward the arms of said outer clamping limb, the outermost lateral section of said first portion being tapered inwardly to a point adjacent said second portion, said second portion being tapered outwardly to a maximum which is less than the outermost lateral section of said first portion, spines being uniformly disposed upon said inner clamping arm lying along the axis thereof, said spines depending from the enlarged ridge of said base member to a point in the proximity of the maximum lateral section of the second portion of said inner clamping arm.

7. A visual indicia clip apparatus as defined in claim 6 wherein said visual indicia bearing means comprises first and second sets of parallel ridges disposed upon the first and second surfaces of said base member, said first and second sets of parallel ridges being disposed perpendicular to one another to form a lattice, said ridges being in uniform spaced relation and forming a uniform disposition of peaks and depressions whereby marking data is removeably disposed thereon.

* * * * *